United States Patent [19]

Stuart

[11] Patent Number: 4,557,547

[45] Date of Patent: Dec. 10, 1985

[54] CONNECTOR FOR ELECTRICAL SUPPLY SYSTEM

[75] Inventor: Robert A. Stuart, Newhaven, England

[73] Assignee: Rotaflex plc, London, England

[21] Appl. No.: 457,058

[22] Filed: Jan. 10, 1983

[30] Foreign Application Priority Data

Jan. 18, 1982 [GB] United Kingdom ..... 8201242

[51] Int. Cl.[4] ..... H01R 13/64

[52] U.S. Cl. ..... 339/184 R; 339/22 R; 339/113 R

[58] Field of Search ..... 339/20, 21 R, 23, 24, 339/22 R, 22 B, 88 R, 32 R, 32 M, 184 R, 184 M, 186 R, 186 M, 113

[56] References Cited

U.S. PATENT DOCUMENTS 2,946,037 7/1960 Platz et al. ..... 339/21 R
3,622,938 11/1971 Stuart ..... 339/21 R
3,686,614 8/1972 Hyrylainen ..... 339/21 R
3,848,715 11/1974 Hesse ..... 339/21 R
4,085,988 4/1978 Gamble ..... 339/154 R
4,211,460 7/1980 Seelbach et al. ..... 339/75 M

FOREIGN PATENT DOCUMENTS 2250737 4/1974 Fed. Rep. of Germany .... 339/22 R

*Primary Examiner*—Gil Weidenfeld
*Assistant Examiner*—Thomas M. Kline
*Attorney, Agent, or Firm*—Arthur B. Colvin

[57] ABSTRACT

A supply connector for an electrical distribution track (1) consisting of a channel housing longitudinal conductors (4) comprises a body (7) carrying contacts (18) for engaging the track conductors, and a polarizing member (23) which cooperates with the track to permit one orientation of the connector in the track, the polarity of the connector being reversible by rotating a member (21) which carries wiring symbols (L,N) to indicate the correct connections between the suuply leads and the terminals for the polarity selected.

9 Claims, 6 Drawing Figures

CONNECTOR FOR ELECTRICAL SUPPLY SYSTEM

This invention relates to electrical supply systems of the kind comprising a supply track in the form of an elongate channel housing a plurality of conductors extending longitudinally of the channel, a supply connector including terminals for attachment of electrical supply leads and contacts connected electrically to the terminals and arranged to contact the conductors of the track when the connector is engaged in the track channel, and one or more adaptors engageable in the track through the open mouth of the channel at any selected position along its length and including contacts engageable with the conductors for supplying electric power to an electrical appliance wired to the adaptor. The invention is concerned in particular with a novel supply connector for such an electrical supply system.

In electrical supply systems of the above kind it is common for the track to be "polarised", i.e. to have a cross-sectional profile which is not symmetrical with respect to a central plane normal to the channel mouth. The polarising which can be easily achieved, for example, by providing an extra bead or flange at one side of the channel, enables each of the adaptors and supply connectors having corresponding asymmetric profiles to be inserted only one way round to ensure that the appliances are connected properly to the different phase leads of the power supply. The majority of supply connectors of electrical supply systems currently available on the market are adapted to be fitted to an end of the track by pushing the supply connector into the open end of the channel, and all have fixed polarity so it has been necessary to provide "lefthand polarised" and "righthand polarised" supply connectors according to which end of the track the supply connector is to be fitted.

The present invention aims at overcoming the above drawbacks and accordingly provides a supply connector for an electrical distribution track having an elongate channel housing a plurality of electrical conductors extending longitudinally thereof, the connector comprising a body, contacts carried by the body for engagement with respective track conductors, terminals for the connection of electrical supply leads, the terminals being carried by the body and connected electrically to the contacts, and polarising means adapted to project from the body for co-operating with the track to allow the connector to be mounted in the channel in one orientation only, characterised in that the polarising means is adjustable relative to the body to project at either side thereof whereby to reverse said allowable orientation of the connector in the track, and indicating means is coupled to the polarising means and is arranged to denote the terminals to which the respective supply leads should be connected for the polarity selected, whereby to ensure that the track conductors are connected to the correct phases of the power supply.

A supply connector of this form can be used at either end of the track simply by reversing the polarity and making sure that the supply leads are wired to the terminals in the correct manner which is indicated by the connector. Thus, only one supply connector need be provided by the manufacturer although the system is a polarised one, and the customer does not have to work out in advance how many left-handed and how many right-handed connectors are needed.

If a supply connector has to be pushed into the end of the track, as with the known connectors, adequate space must be left at the end of the track when it is mounted to allow the supply connector to be inserted. Furthermore, as sometimes occurs, especially when installing complicated systems of track networks, the end of a track length does not always coincide with the position at which, for example, the power supply cable emerges from the ceiling or another track, and as a result the cable must run along the track to the supply connector and be concealed however possible. These disadvantages are avoided in a preferred embodiment of the invention in that the contacts are retractible relative to the body by adjustment of an operating member whereby to enable the connector to be inserted into the track through the channel mouth.

With the contacts retractible and the connector insertable through the mouth of the track channel, the connector is very versatile insofar as it can be fitted to the track at any position along its length and either way round.

It is preferred that the polarising means and contact operating member be so arranged that the contacts must be retracted before the polarising means can be adjusted. In this way it can be ensured that the polarising means is adjusted according to the chosen polarity and the connection of the supply leads to the terminals may be checked against the indicating means before the contacts are brought into engagement with the track conductors.

In a preferred embodiment of the invention the contact operating member constitutes a pivotally mounted cover and includes a pair of cams for controlling the contacts, the cover being arranged to be closed when the contacts are extended and to deny access to the polarising means when in its closed position. The polarising means itself comprises a rotary member which can be turned to adjust a radial finger thereon to project to one side or the other side of the housing. The rotary member interferes with the cover to prevent its closure to extend the contacts unless the finger is correctly adjusted to project at either side. The rotary member is positioned adjacent a pair of terminals and carries markings, e.g. letters "L" and "N" indicating the correct live and neutral connections, which align with opposite respective terminals according to the selected direction of polarisation.

With the supply connector of the invention the polarisation is reversible but the indications provided, if followed, will ensure that the track conductors will always be connected to the correct respective supply leads, and there is no risk of any appliances becoming connected to the power supply with the phases inverted.

A full understanding of the invention will be had from the following detailed description which is given with reference to the accompanying drawings in which.

Figure 1:
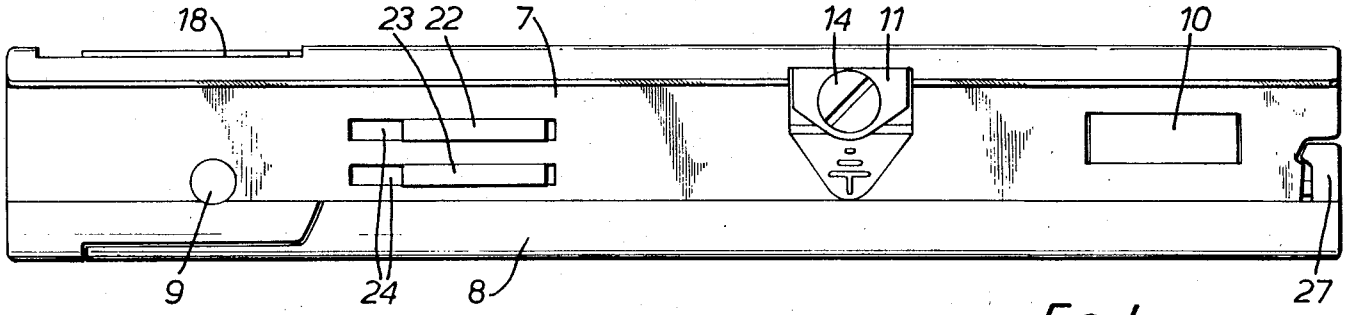
FIG. 1 is a side view of the supply connector.
Figure 2:
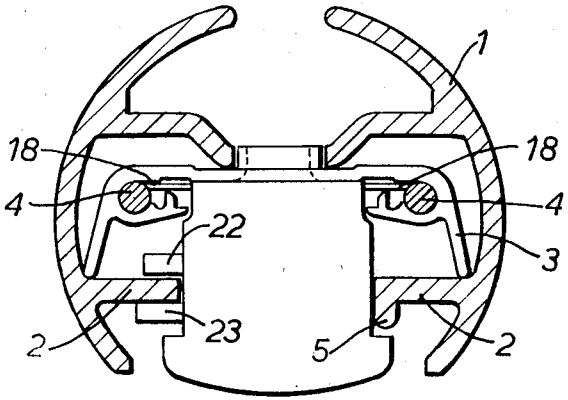
FIG. 2 is an end view of the connector in operative position in a track.
Figure 3:
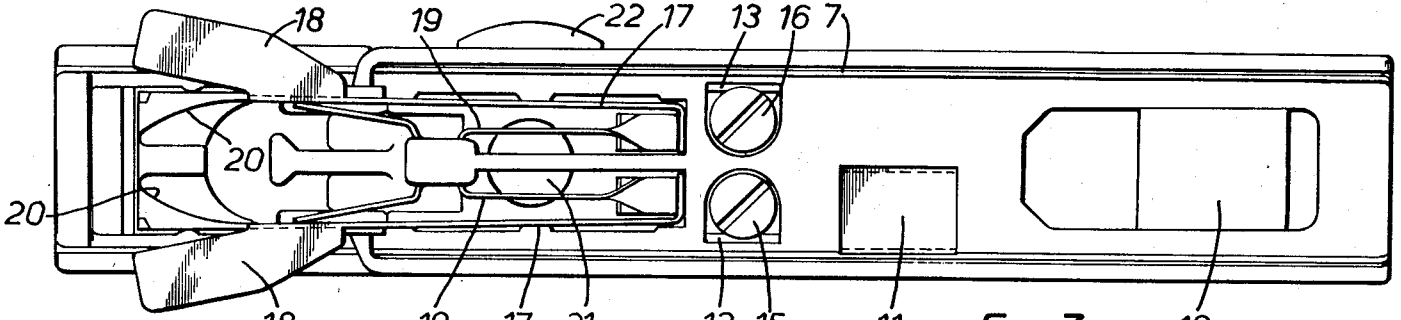
FIG. 3 is a top plan view of the supply connector.

The supply connector illustrated in the drawings is intended for use with a supply track which, as seen in FIG. 2, comprises a channel section 1 having a pair of opposed flanges 2 adjacent the channel mouth and supporting an insulating insert 3 which carries the track conductors 4. One of the flanges has a polarising bead 5 which makes the track asymmetric with respect to the longitudinal vertical plane.

The supply connector has a housing 7 with a bottom cover 8 which is mounted to pivot about a pin 9. Located in the housing at one end of the connector is a cable clamp 10 the screw 10A of which is accessible when the cover 8 is pivoted open. Three electric terminals 11, 12, 13 are mounted within the housing, namely the earth terminal 11 which has a clamp screw 14 accessible through a hole in a sidewall of the housing and which is attached to an earth contact adapted to engage one of the track flanges 2, and the two power or line terminals 12, 13 which are arranged side by side and have clamp screws 15, 16 accessible through holes in the top wall of the housing. Attached to each power terminal is a contact blade 17 which includes a longitudinally extending resilient portion the free end of which is bent through 90° to provide a relatively stiff contact tip 18. The blade tip is urged outwardly by a leaf spring 19 having a bowed intermediate portion resting against an interior wall of the housing, and the root end of which is bent in the form of an U-shaped tongue 19A to anchor the spring in the housing.

Integral with the cover 8 are a pair of opposed cam surfaces 20 which cooperate with the outer surfaces of the resilient contact blade portions and are shaped in the manner of wedges so that as the cover is pivoted to its open position the contacts are moved inwardly against the bias of springs 19 until the tips 18 are retracted within the housing.

Figure 4:
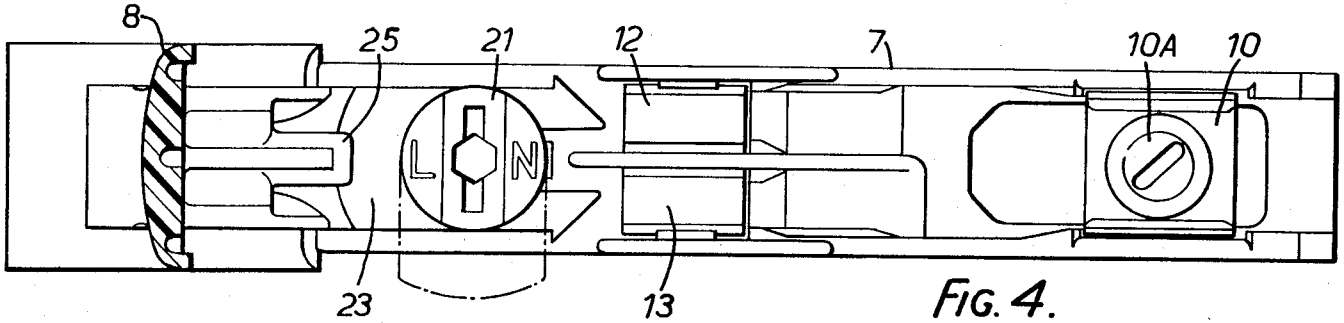
FIG. 4 is an underneath view with the cover in an open position.

Mounted in the housing for rotation about a vertical axis is a member 21 having a pair of vertically aligned lugs 22, 23. Each side wall of the housing is provided with a pair of openings 24 through which the lugs may be brought to protrude by rotational adjustment of the member 21 which is provided with hexagonal key and screw driver slots for this purpose. The upper lug 22 engages the upper side of the plane flange 2 of the track to secure the connector in the track whilst the lower lug 23 constitutes a polarising lug and underlies this flange. The bead 5 on the other track flange prevents the member 21 being rotated in the opposite direction by abutting lug 23. Carried on the lower surface of the member 21 are polarity indications in the form of the letters "L" and "N" which are diametrically opposite and in radial alignment with the lugs 22, 23. Starting in the position shown in FIG. 4 with the lugs retracted within the housing to enable the connector to be inserted into a track channel, the member may be rotated either clockwise to bring the marking "L" and "N" into position adjacent the terminals 12 and 13 respectively, or counter clockwise so that the markings are reversed with respect to the two terminals. Of course when the connector is positioned in the track rotation in one direction only is possible due to the beaded track flange, and this direction will depend on which way the connector is facing. However, provided the live and neutral supply leads are connected to the terminals as indicated by the "L" and "N" markings on the polarity member 21, the track conductor above the plane flange 2 will be connected to the positive of the supply voltage and the conductor above the beaded flange will be connected to the neutral of the supply.

The pivotal cover 8 has a tongue 25 which projects in a direction normal to the plane of the cover. When the cover is open and the member 21 is rotated to retract the lugs 22, 23, the tongue abuts the lug 23 to prevent the cover being closed, and hence the contacts being extended, until the member 21 has been turned to polarise the supply connector correctly. Furthermore, when the cover 8 is closed fingers 26 on the cam portions engage the member 21 to lock it in the adjusted position with the lugs extended. To retain the cover in the closed position it is provided with latching projections 27 at its free end for snap engagement with the housing.

Figure 5:
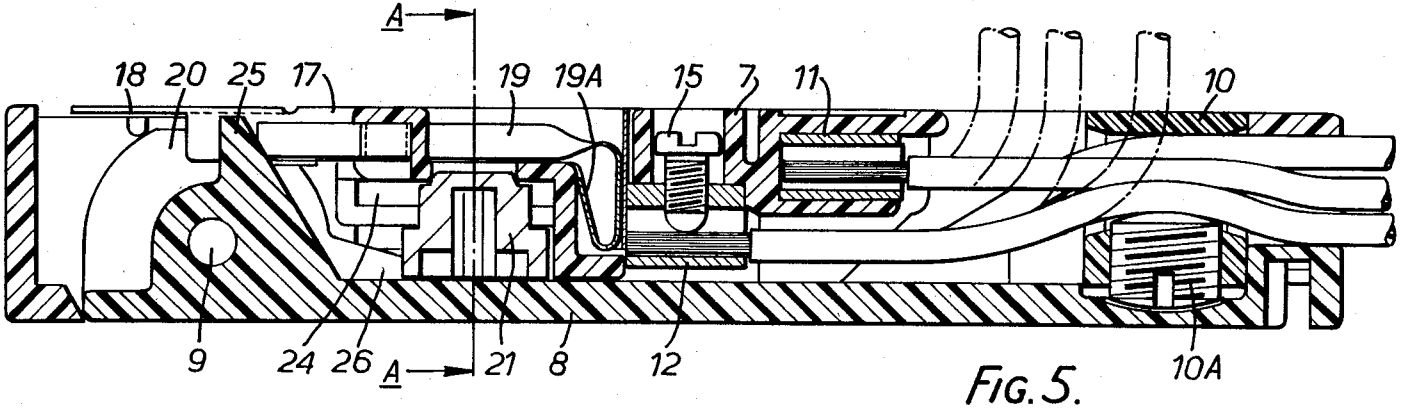
FIG. 5 is a longitudinal cross section.
Figure 6:
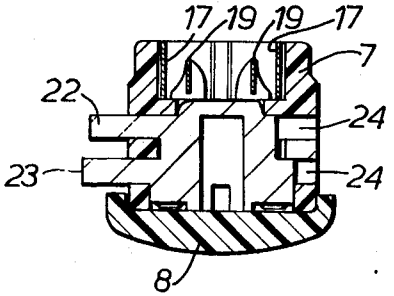
FIG. 6 is a section taken along the line A—A of FIG. 5.

In use the supply leads are wired to the respective terminals, the live and neutral wires being connected to terminals 12 and 13 according to the desired polarity. If preferred the supply leads may be taken through the top of the housing rather than the end wall as indicated by chain dot lines in FIG. 5. With the cover 8 open and hence the contact tips 18 retracted, and with the lugs 22, 23 retracted the supply connector is inserted into the track channel. The polarity member 21 is then rotated according to the selected polarity to bring the lugs 22, 23 into position on opposite sides of the plane flange 2. This also brings the "L" and "N" markings into position adjacent the terminals 12, 13 to which the live and neutral leads should have been connected. (If the wiring is incorrect the connections to terminals 12, 13 must be reversed or the connector must be reversed in the track). The cover is then closed allowing the springs 19 to push the contacts 17 outwardly to bring their tips 18 into contact with the track conductors 4, and locking the polarity member in its adjusted position with fingers 26.

Due to the configuration of the housing and the facility to reverse the polarity the supply connector can be mounted in the track at either end, or even intermediate the ends, and facing either way.

What is claimed is:

1. In a supply connector for an electrical distribution track having an elongate channel and a plurality of electrical conductors housed in the channel and extending longitudinally thereof, said track including a longitudinally extending polarizing abutment, the connector comprising a body, contacts retractably carried by said body for engagement with respective track conductors, contact operating means movably mounted on said body for shifting said contacts between a retracted position enabling insertion of said connector into said channel and an extended position in contact with said conductors, fixed terminals on said body for the connection of electrical supply leads, the terminals being electrically connected to the contacts, and polarizing means adapted to project from the body for cooperating with the track to allow the connector to be mounted in the channel in either of two orientations 180° offset one from the other, the improvement which comprises means for selectively adjusting the polarizing means relative to the body to project at either side thereof whereby to reverse said allowable orientation of the connector in the track, indicating means coupled to the polarizing means and arranged to denote the terminals to which the supply leads should be respectively connected for the polarity selected, whereby to ensure that the track conductors are connected to the correct phases of the power supply, said polarizing means and contact operating means being cooperatively arranged such that said means for adjusting said polarizing means can be adjusted only in said retracted position of said contacts.

2. A supply connector according to claim 1, wherein the contact operating means comprises a cover member movably mounted to the body for adjustment between an open position in which the contacts are retracted and a closed position covering the means for adjusting the polarizing means to deny access thereto.

3. A supply connector according to claim 2, wherein the polarizing means comprises a member movably mounted in the body and arranged to interfere with the cover member to prevent the cover member from being closed when the polarizing member is not adjusted to project at one side or the other side of the body.

4. A supply connector according to claim 3, wherein the cover member is pivoted to the body and is provided with cam means for acting on the contacts to adjust the contacts between the retracted and extended positions thereof.

5. A supply connector according to claim 1, wherein the polarizing means comprises a member rotatably mounted to the body adjacent the terminals and the indicating means comprises phase symbols carried on said member.

6. A supply connector according to claim 5, wherein the polarizing member includes a radial polarizing finger and is rotatable to adjust said finger to protrude at one side or the other side of the body.

7. A supply connector according to claim 5, wherein the polarizing member includes a radially projecting locking element arranged to project from the body for engaging the channel to secure the connector in the track.

8. In a supply connector for an electrical distribution track having an elongate channel having an open mouth and a plurality of electrical conductors housed in the channel and extending longitudinally thereof, said track including a longitudinally extending polarizing abutment, the connector comprising a body, contacts retractably carried by said body for engagement with respective track conductors, fixed terminals on said body for the connection of electrical supply leads, the terminals being connected electrically to the contacts and polarizing means adapted to project from the body for cooperating with the track to allow the connector to be mounted in the channel in either of two orientations 180° offset one from the other, the improvement which comprises means for selectively adjusting said polarizing means relative to said body between one of two retracted positions whereat said connector may be inserted into said channel in one of two extended positions at opposite sides of said body whereat said connector is locked to said track, said connector being positioned in one or the other of said two orientations selectively in accordance with the selected one of said extended positions of said polarizing means, polarity indicating means on said polarizing means positioned to lie adjacent said fixed terminals in said retracted positions of said polarizing means, said polarizing means and track being cooperatively arranged to enable said polarizing means to be shifted only to the one of said two extended positions corresponding to the polarity denoted by said indicating means relative to said fixed terminals when said polarizing means is in a respective retracted position.

9. A supply connector according to claim 8, wherein the said contacts are retractible relative to the body, and a contact operating member is provided for retracting the contacts whereby to enable the connector to be inserted into the track through the mouth of the channel.

* * * * *